US009863290B2

(12) United States Patent
Mitsutani

(10) Patent No.: US 9,863,290 B2
(45) Date of Patent: Jan. 9, 2018

(54) VALVE TIMING ADJUSTING DEVICE

(71) Applicant: DENSO CORPORATION, Kariya, Aichi-pref. (JP)

(72) Inventor: Tetsurou Mitsutani, Kariya (JP)

(73) Assignee: DENSO CORPORATION, Kariya (JP)

( * ) Notice: Subject to any disclaimer, the term of this patent is extended or adjusted under 35 U.S.C. 154(b) by 150 days.

(21) Appl. No.: 15/091,713

(22) Filed: Apr. 6, 2016

(65) Prior Publication Data

US 2016/0298505 A1 Oct. 13, 2016

(30) Foreign Application Priority Data

Apr. 8, 2015 (JP) ..... 2015-79185

(51) Int. Cl.
*F01L 1/34* (2006.01)
*F01L 1/344* (2006.01)
*F01L 1/02* (2006.01)

(52) U.S. Cl.
CPC ..... *F01L 1/3442* (2013.01); *F01L 1/024* (2013.01); *F01L 2001/3443* (2013.01); *F01L 2001/34433* (2013.01); *F01L 2001/34469* (2013.01); *F01L 2001/34479* (2013.01); *F01L 2810/02* (2013.01); *F01L 2820/031* (2013.01)

(58) Field of Classification Search
CPC . F01L 1/024; F01L 1/3442; F01L 2001/3443; F01L 2001/34433; F01L 2001/34469; F01L 2810/02
USPC ..... 123/90.15, 90.17
See application file for complete search history.

(56) References Cited

U.S. PATENT DOCUMENTS 7,506,621 B2 * 3/2009 Takahashi ..... F01L 1/022 123/90.17
8,910,602 B2 12/2014 Bohner et al.
2015/0075460 A1 3/2015 Mitsutani

FOREIGN PATENT DOCUMENTS

DE 10 2013 212 943 1/2015
WO WO 2016/163119 10/2016

OTHER PUBLICATIONS

Mitsutani, U.S. Appl. No. 15/564,874, filed Oct. 6, 2017 (25 pages)—corresponds to WO 2016/163119.

* cited by examiner

*Primary Examiner* — Ching Chang
(74) *Attorney, Agent, or Firm* — Nixon & Vanderhye P.C.

(57) ABSTRACT

A valve timing adjusting device includes a housing, a vane rotor, a sleeve, and a spool. The housing includes a timing pulley connected to a crank shaft through a dry belt, and rotates in association with the crank shaft. The sleeve includes a supply port, a drain port, a first control port, a second control port, and a first drain oil channel. The spool includes an oil connection channel that is arranged at an axial center portion of the spool and controls the supply port to be connected with the first control port or the second control port depending on an axial-direction position. The drain port is connected with a first drain space through a second drain oil channel. A second drain space is connected with the first drain space through a third drain oil channel that is provided to span the vane rotor and the cam shaft.

4 Claims, 6 Drawing Sheets

VALVE TIMING ADJUSTING DEVICE

CROSS REFERENCE TO RELATED APPLICATION

This application is based on Japanese Patent Application No. 2015-79185 filed on Apr. 8, 2015, the disclosure of which is incorporated herein by reference.

TECHNICAL FIELD

The present disclosure relates to a valve timing adjusting device.

BACKGROUND

It is well known that a valve timing adjusting device is arranged in a power transmission passage that transmits a power from a driving shaft of an internal combustion engine to a driven shaft of the internal combustion engine, and the valve timing adjusting device adjusts a valve timing of an intake valve or an exhaust valve which is driven to open and to close by the driven shaft. When the valve timing adjusting device is hydraulic, the valve timing adjusting device includes a housing that rotates in association with one of the driving shaft and the driven shaft and a vane rotor that is fixed to an end portion of the other one of the driving shaft and the driven shaft. Further, the vane rotor rotates relative to the housing in an advance direction or a retard direction by supplying an operation oil to one of a first oil pressure chamber and a second oil pressure chamber which are included in the housing. A supply of the operation oil is executed by an oil channel switching valve.

According to U.S. Pat. No. 8,910,602B2, in the valve timing adjusting device, the oil channel switching valve is a valve that is arranged at a center portion of the vane rotor and includes a spool. The oil channel switching valve includes a sleeve that includes various ports, and the spool that moves in the spool in an axial direction of the spool.

The sleeve is a tubular shape and extends in the axial direction. The sleeve includes a supply port, a first drain port, a first control port, a second control port, and a second drain port, in this order from a cam shaft. The supply port communicates with an oil supply channel of the cam shaft. The first drain port communicates with a first drain space that is placed at a position out of the cam shaft, through a drain oil channel that penetrating the cam shaft in a radial direction. The first control port communicates with the first oil pressure chamber. The second control port communicates with the second oil pressure chamber. The second drain port communicates with a second drain space opposite to the cam shaft relative to the vane rotor.

The spool includes an oil connection channel that is arranged at an axial center portion of the spool and controls the supply port to be connected with the first control port or the second control port depending on an axial-direction position of the spool.

When the operation oil is supplied to the first oil pressure chamber, the oil channel switching valve controls the supply port to be connected with the first control port and controls the second control port to be connected with the second drain port. In this case, the operation oil in the second oil pressure chamber flows into the second drain port through the second control port, and then is discharged to the second drain space. When the operation oil is supplied to the second oil pressure chamber, the oil channel switching valve controls the supply port to be connected with the second control port and controls the first control port to be connected with the first drain port. In this case, the operation oil in the first oil pressure chamber flows into the drain oil channel through the first control port and the first drain port, and then is discharged to the first drain space.

SUMMARY

It is necessary to return the operation oil discharged to the first drain space and the second drain space back to an oil storage portion of the internal combustion engine. Therefore, in the valve timing adjusting device disclosed in U.S. Pat. No. 8,910,602B2, the first drain space and the second drain space communicates with each other through a space that is placed at a position out of the housing.

However, when a timing pulley is arranged at an outer wall of the housing, a space to which the timing pulley is exposed is placed at a position between the first drain space and the second drain space and communicates with the first drain space and the second drain space. Therefore, the operation oil discharged to the first drain space and the second drain space adheres to the timing pulley and a dry belt, and a relative slide between the timing pulley and the dry belt may be generated.

It is an object of the present disclosure to provide a valve timing adjusting device in which an oil connection channel is arranged at an axial center portion of an oil channel switching valve, and it can be avoided that an operation oil discharged from the oil channel switching valve to an external space adheres to a timing pulley and a dry belt.

According to an aspect of the present disclosure, the valve timing adjusting device includes a housing, a vane rotor, a sleeve, and a spool. One of a driving shaft and a driven shaft is expressed as a first shaft, and the other one of the driving shaft and the driven shaft is expressed as a second shaft. The housing includes a timing pulley connected to the first shaft through a dry belt, and rotates in association with the first shaft.

The vane rotor is fixed to an end portion of the second shaft, and includes a vane dividing an inner space of the housing into a first oil pressure chamber and a second oil pressure chamber which are arranged at one side and the other side relative to the vane in a peripheral direction, respectively. The vane rotor rotates relative to the housing depending on oil pressures of operation oil supplied to the first oil pressure chamber and the second oil pressure chamber.

The sleeve is arranged at a center portion of the vane rotor. The sleeve includes a supply port, a drain port, a first control port, a second control port, and a first drain oil channel, in this order from the second shaft. The supply port communicates with an oil supply channel of the second shaft. The drain port communicates with a first drain space placed at a position out of the second shaft. The first control port communicates with the first oil pressure chamber. The second control port communicates with the second oil pressure chamber. The first drain oil channel communicates with a second drain space opposite to the second shaft relative to the vane rotor.

The spool moves in an axial direction in the sleeve. The spool includes an oil connection channel that is arranged at an axial center portion of the spool and controls the supply port to be connected with the first control port or the second control port depending on an axial-direction position of the spool. The spool controls the supply port to be connected with the first control port and controls the second control port to be connected with the first drain oil channel in a case where the operation oil is supplied to the first oil pressure chamber. The spool controls the supply port to be connected with the second control port and controls the first control port to be connected with the drain port in a case where the operation oil is supplied to the second oil pressure chamber.

The drain port is connected with the first drain space through a second drain oil channel that is arranged in the second shaft or is provided to span the vane rotor and the second shaft. The second drain space is connected with the first drain space through a third drain oil channel that is provided to span the vane rotor and the second shaft.

In the valve timing adjusting device, the second drain space communicates with the first drain space through the third drain oil channel. Therefore, the operation oil in the second oil pressure chamber flows into the second drain space through the second control port and the first drain oil channel and then is discharged to the first drain space through the third drain oil channel. Thus, even though a space to which a timing pulley of the housing is exposed is sealed relative to the first drain space and the second drain space, the operation oil discharged to the first drain space and the second drain space can be returned to an oil storage portion of the internal combustion engine without being leaked. Thus, the oil connection channel is arranged at the axial center portion of the spool of the oil channel switching valve, and it can be prevented that the operation oil discharged from the oil channel switching valve to an external space adheres to the timing pulley and the dry belt.

BRIEF DESCRIPTION OF THE DRAWINGS

The above and other objects, features and advantages of the present disclosure will become more apparent from the following detailed description made with reference to the accompanying drawings. In the drawings.

DESCRIPTION OF EMBODIMENTS

Figure 1:
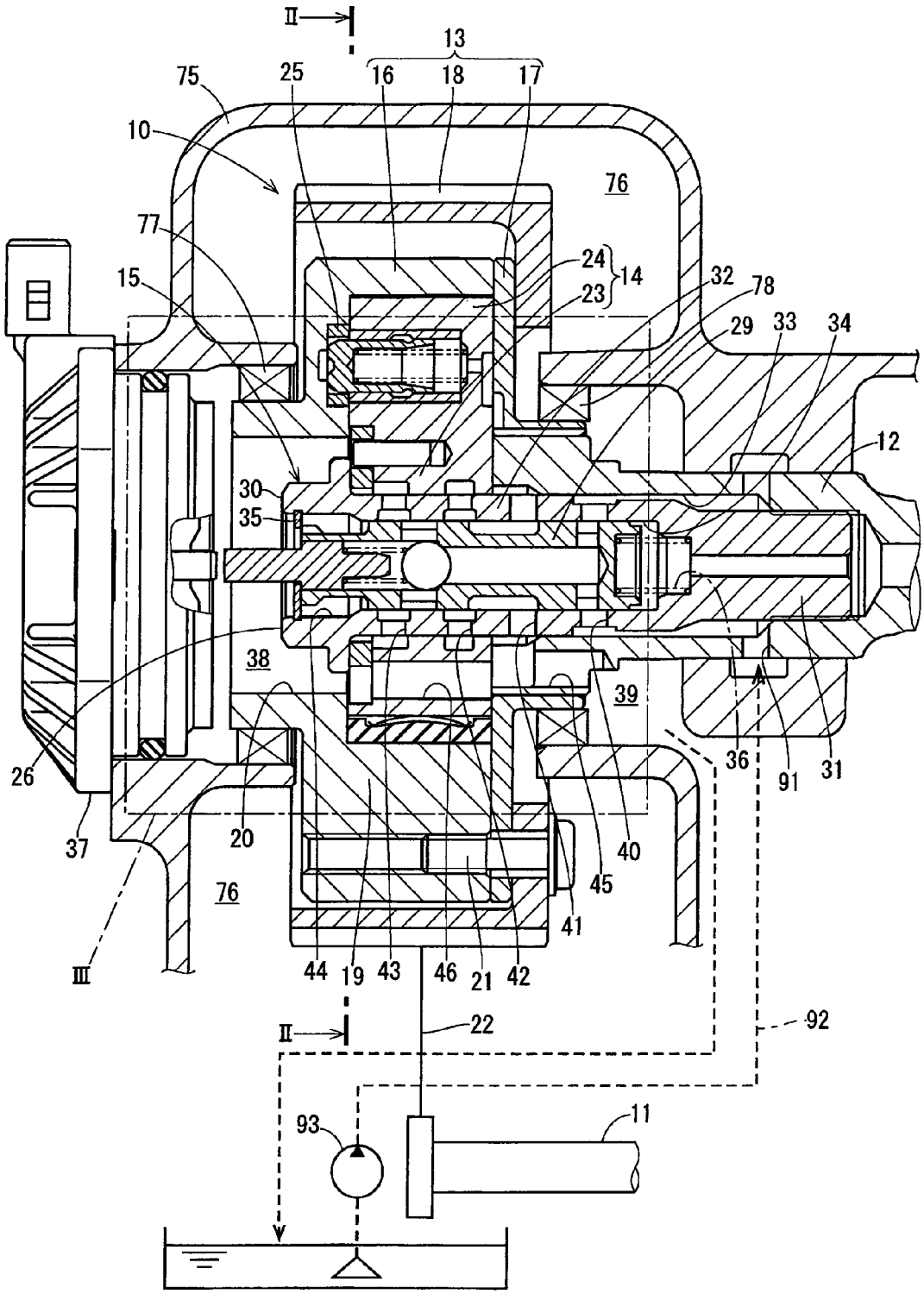
FIG. 1 is a cross-sectional view showing a valve timing adjusting device according to a first embodiment of the present disclosure.

Hereafter, embodiments of the present disclosure will be described referring to drawings. The substantially same parts and the components are indicated with the same reference numeral and the same description will be omitted.

First Embodiment

FIG. 1 is a diagram showing a valve timing adjusting device 10 according to a first embodiment of the present disclosure. The valve timing adjusting device 10 changes a rotational phase of a cam shaft 12 relative to a crank shaft 11 of an internal combustion engine, so as to adjust a valve timing of an intake valve that is not shown and is driven by the cam shaft 12 to open and close. The valve timing adjusting device 10 is arranged in a power transmission passage that transmits a power from the crank shaft 11 to the cam shaft 12. The crank shaft 11 is a driving shaft. The cam shaft 12 is a driven shaft.

Figure 2:
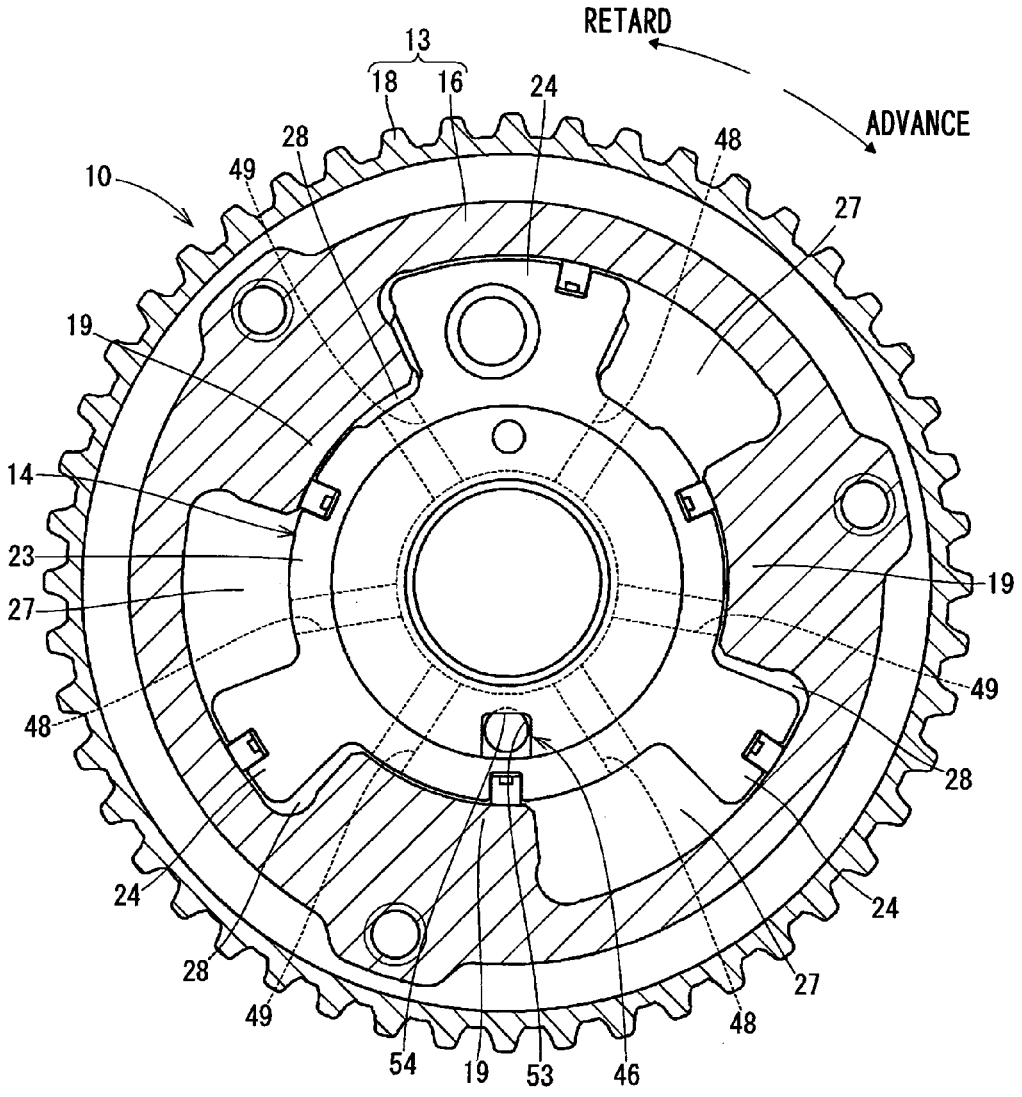
FIG. 2 is a diagram showing a housing and a vane rotor, viewed from a line II-II in FIG. 1.

Referring to FIGS. 1 and 2, a basic configuration of the valve timing adjusting device 10 will be described.

The valve timing adjusting device 10 includes a housing 13, a vane rotor 14, and an oil channel switching valve 15.

The housing 13 includes a case 16, a cover 17, and a timing pulley 18. The case 16 is a bottomed tubular shape, and is coaxial with the cam shaft 12. The case 16 includes plural dividing wall portions 19 which protrude inwardly in a radial direction. The case 16 includes an opening portion 20 that is exposed to a space out of the case 16, and the opening portion 20 is placed at a center of a bottom of the case 16. The opening portion 20 is included in a drain space 38. The vane rotor 14 is interposed between the cam shaft 12 and the drain space 38. In other words, the drain space 38 is opposite to the cam shaft 12 relative to the vane rotor 14. The drain space 38 is a second drain space. The cover 17 is fitted to an end portion of the cam shaft 12, and is fastened to an opening end portion of the case 16 by a bolt 21. The timing pulley 18 is fixed to the case 16 together with the cover 17 by the bolt 21. A dry belt 22 is wound around the timing pulley 18 and the crank shaft 11. The housing 13 rotates in association with the crank shaft 11.

The vane rotor 14 includes a boss 23, plural vanes 24, and a plate washer 25. The boss 23 is a tubular shape, and is fixed to the end portion of the cam shaft 12 by a sleeve bolt 26. The vane 24 protrudes from the boss 23 outwardly in the radial direction. A space divided by each of the dividing wall portions 19 of the case 16 is divided by the vane 24 into a retard chamber 27 and an advance chamber 28. The retard chamber 27 is a first oil pressure chamber, and is placed at a side relative to the vane 24 in a peripheral direction. The advance chamber 28 is a second oil pressure chamber, and is placed at the other side relative to the vane 24 in the peripheral direction. The plate washer 25 is a member that is separated from the boss 23 and the vane 24, and is fastened to the cam shaft 12 together with the boss 23 by the sleeve bolt 26. The vane rotor 14 rotates relative to the housing 13 in a retard direction or in an advance direction depending on oil pressures in the retard chamber 27 and the advance chamber 28.

The oil channel switching valve 15 is placed at a center portion of the vane rotor 14, and includes the sleeve bolt 26 and a spool 29.

The sleeve bolt 26 is a bolt of a half thread type. The sleeve bolt 26 is inserted into the vane rotor 14 from the drain space 38, and then is threaded into the cam shaft 12. The sleeve bolt 26 includes a head portion, a thread portion 31, and a sleeve 32 interposed between the head portion 30 and the thread portion 31. The sleeve 32 is a tubular shape, and extends in the center portion of the vane rotor 14 in an axial direction. The sleeve 32 penetrates the boss 23, and is inserted into a bottomed hole 33 that is opened to an end surface of the cam shaft 12. The sleeve 32 includes various ports which penetrate in the radial direction.

The spool 29 moves in a spool receiving hole 34 in the axial direction. The spool receiving hole 34 is a bottomed tubular shape, and is included in the sleeve 32. The spool receiving hole 34 includes an opening end to which a stopper plate 35 is fitted. The spool 29 is biased toward the stopper plate 35 by a spring 36. An axial-direction position of the spool 29 that is a position of the spool 29 in the axial direction is determined by a balance between a biasing force of the spring 36 and a pressing force of a linear solenoid 37.

The linear solenoid 37 is placed at a position opposite to the spool 29 relative to the stopper plate 35. The spool 29 is selectively connected with each of the ports of the sleeve 32, depending on the axial-direction position.

The oil channel switching valve 15 operates in a first operation state where an oil pump 93 is connected with the retard chamber 27 and the advance chamber 28 is connected with the drain space 38, a second operation state where the oil pump 93 is connected with the advance chamber 28 and the retard chamber 27 is connected with the drain space 38, or a holding state where the oil channel switching valve blocks both the retard chamber 27 and the advance chamber 28. In the first operation state, an operation oil is supplied to the retard chamber 27, and is discharged from the advance chamber 28. In the second operation state, the operation oil is supplied to the advance chamber 28, and is discharged from the retard chamber 27. In the holding state, the operation oil in the retard chamber 27 and in the advance chamber 28 is maintained.

As the above configuration, when the rotational phase of the cam shaft 12 is advanced relative to a target value, the valve timing adjusting device 10 controls the oil channel switching valve 15 to operate in the first operation state. Therefore, the vane rotor 14 rotates relative to the housing 13 in the retard direction, and the rotational phase of the cam shaft 12 is retarded.

When the rotational phase of the cam shaft 12 is retarded relative to the target value, the valve timing adjusting device 10 controls the oil channel switching valve 15 to operate in the second operation state. Therefore, the vane rotor 14 rotates relative to the housing 13 in the advance direction, and the rotational phase of the cam shaft 12 is advanced.

When the rotational phase of the cam shaft 12 matches the target value, the valve timing adjusting device 10 controls the oil channel switching valve 15 to operate in the holding operation. Therefore, the rotational phase of the cam shaft 12 is maintained to be constant.

Referring to FIGS. 1 to 5, a detailed configuration of the valve timing adjusting device 10 will be described.

Figure 3:
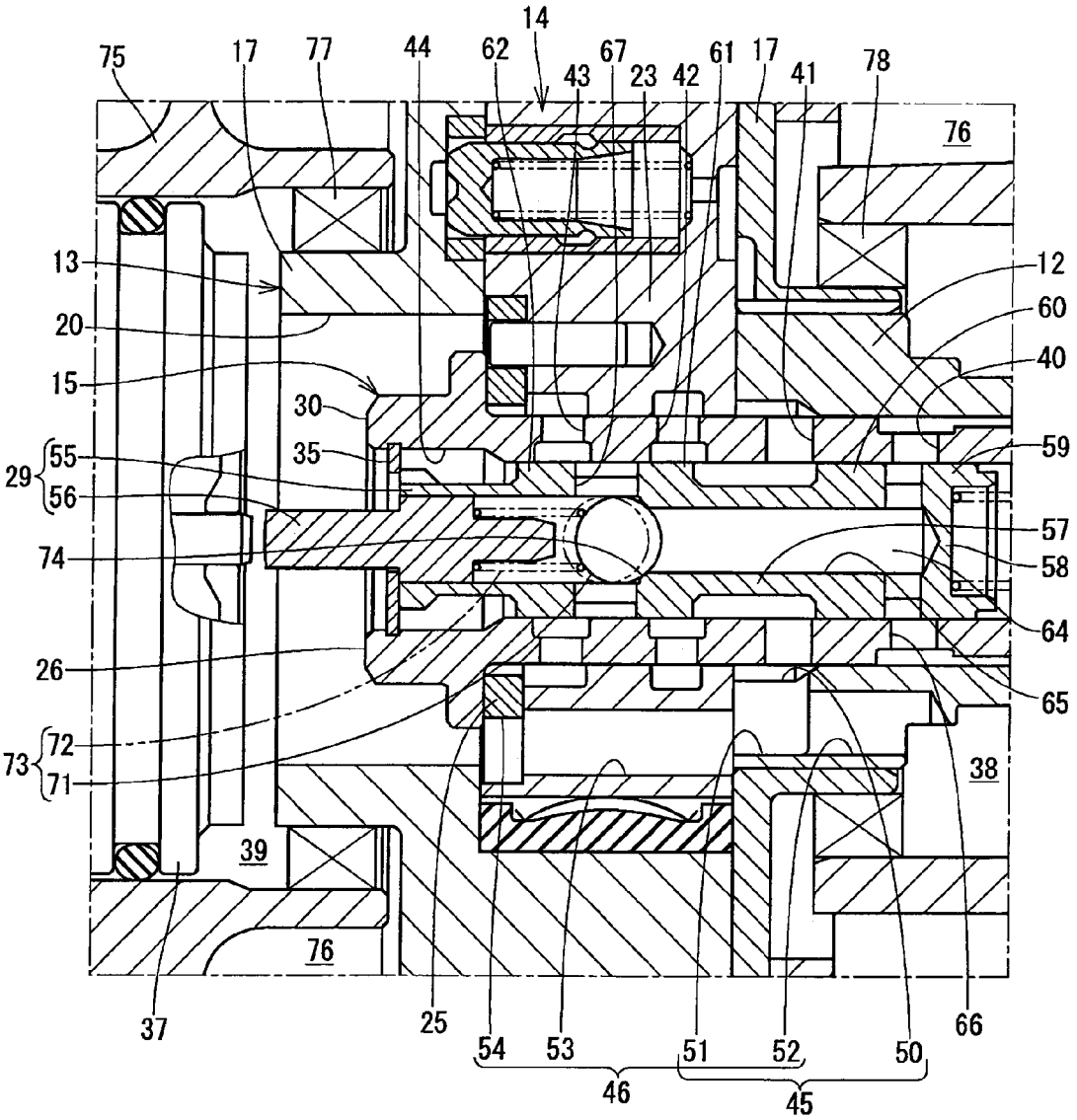
FIG. 3 is an enlarged diagram of an area III in FIG. 1 showing an initial position of a spool of an oil channel switching valve.

As shown in FIGS. 1 and 3, the sleeve 32 includes a supply port 40, a drain port 41, a first control port 42, a second control port 43, and a first drain oil channel 44, in this order from the cam shaft 12. The supply port 40 communicates with a discharge port of the oil pump 93 through oil supply channels 91 and 92. The drain port 41 communicates with a drain space 39 through a second drain oil channel 45. The drain space 39 is a space out of the cam shaft 12. The drain space 39 is a first drain space. The first control port 42 communicates with the retard chamber 27 through a retard oil channel 48 of the vane rotor 14. The second control port 43 communicates with the advance chamber 28 through an advance oil channel 49 of the vane rotor 14. The first drain oil channel 44 is a ring-shaped gap between the sleeve bolt 26 and the spool 29, and communicates with the drain space 38. The drain space 38 is connected with the drain space 39 through a third drain oil channel 46 that spans the vane rotor 14 and the cam shaft 12.

The cam shaft 12 includes the oil supply channel 91, a ring-shaped groove 50 that is arranged at an opening end portion of the bottomed hole 33 and is a ring shape, a notch 51 that extends from the ring-shaped groove 50 outwardly in the radial direction, and a through hole 52 that penetrates from the notch 51 to the drain space 39. The oil supply channel 91 is connected with the oil pump 93 through the oil supply channel 92 that is arranged in a cylinder head. The ring-shaped groove 50 and the notch 51 are placed at positions being separated from the vane rotor 14 by a distance smaller than a distance by which the ring-shaped groove 50 and the notch 51 are separated from the oil supply channel 91.

The boss 23 includes a through hole 53 that penetrates in the axial direction. A position of the through hole 53 in the peripheral direction is as the same as a position of the notch 51 in the peripheral direction. At least a part of the through hole 53 overlaps the notch 51 in the radial direction. Therefore, a first end of the through hole 53 communicates with the notch 51.

The plate washer 25 includes a notch 54 that extends inwardly in the radial direction. A position of the notch 54 in the peripheral direction is as the same as the position of the through hole 53 in the peripheral direction. At least a part of the notch 54 overlaps the through hole 53 in the radial direction. Therefore, the notch 54 communicates with a second end of the through hole 53.

The second drain oil channel 45 includes the ring-shaped groove 50 formed in the cam shaft 12, the notch 51, and the through hole 52. According to the present embodiment, the second drain oil channel 45 is only arranged in the cam shaft 12.

The third drain oil channel 46 includes the notch 54 and the through hole 53 which are formed in the vane rotor 14, and the notch 51 and the through hole 52 which are formed in the cam shaft 12. According to the present embodiment, a part of the third drain oil channel 46 is a part of the second drain oil channel 45. In this case, the part of the third drain oil channel 46 and the part of the second drain oil channel 45 are the notch 51 and the through hole 52.

The linear solenoid 37 is mounted to a belt cover 75 including an inner space where a seal member 77 is interposed between a pulley exposure space 76 that is a space to which the timing pulley 18 is exposed and the drain space 38. A seal member 78 is interposed between the pulley exposure space 76 and the drain space 39. Thus, the pulley exposure space 76 is sealed relative to the drain space 38 and the drain space 39. The drain space 39 communicates with an oil storage portion of the internal combustion engine.

The spool 29 includes a bottomed tubular member 55 that is a bottomed tubular shape and a stopper member 56.

Figure 4:
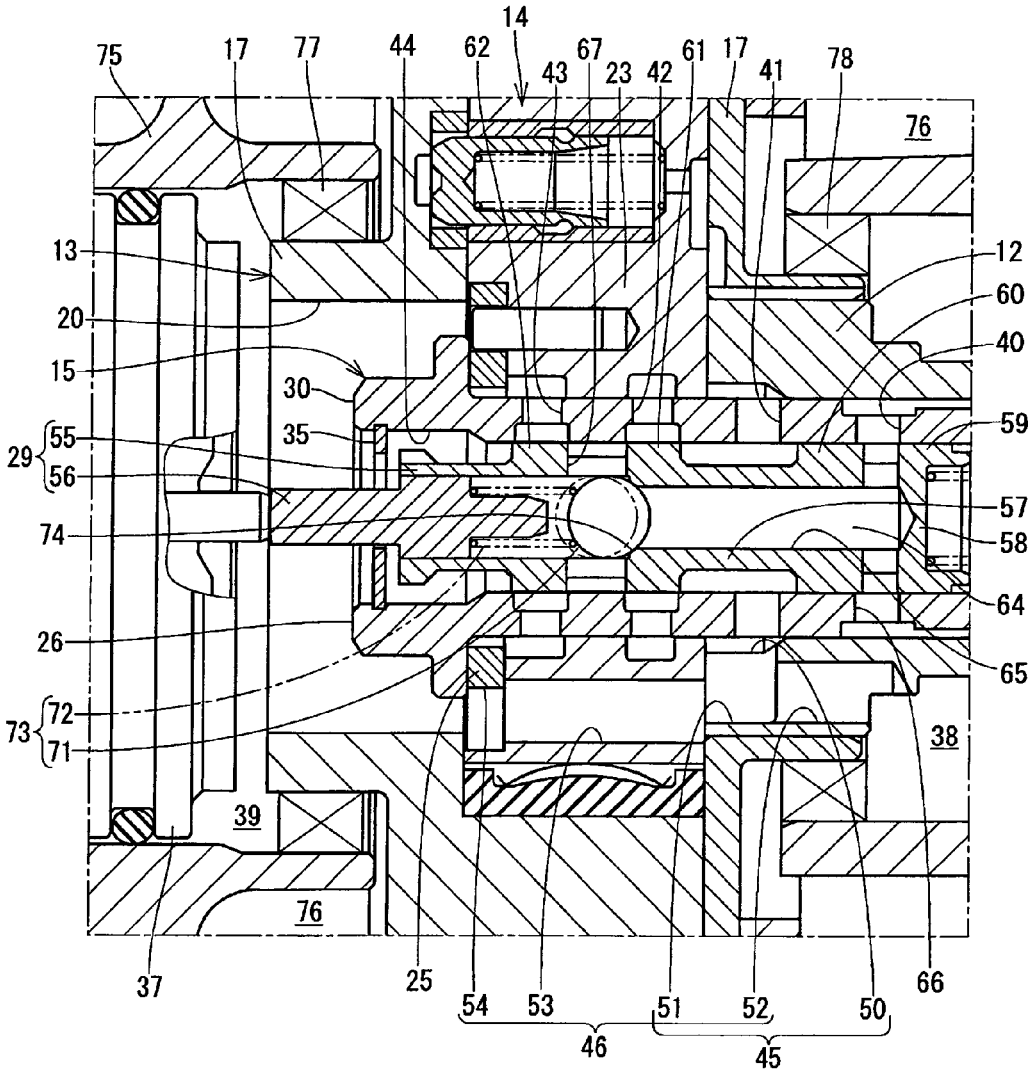
FIG. 4 is a diagram showing the spool that moves by a predetermined distance from a position in FIG. 3.
Figure 5:
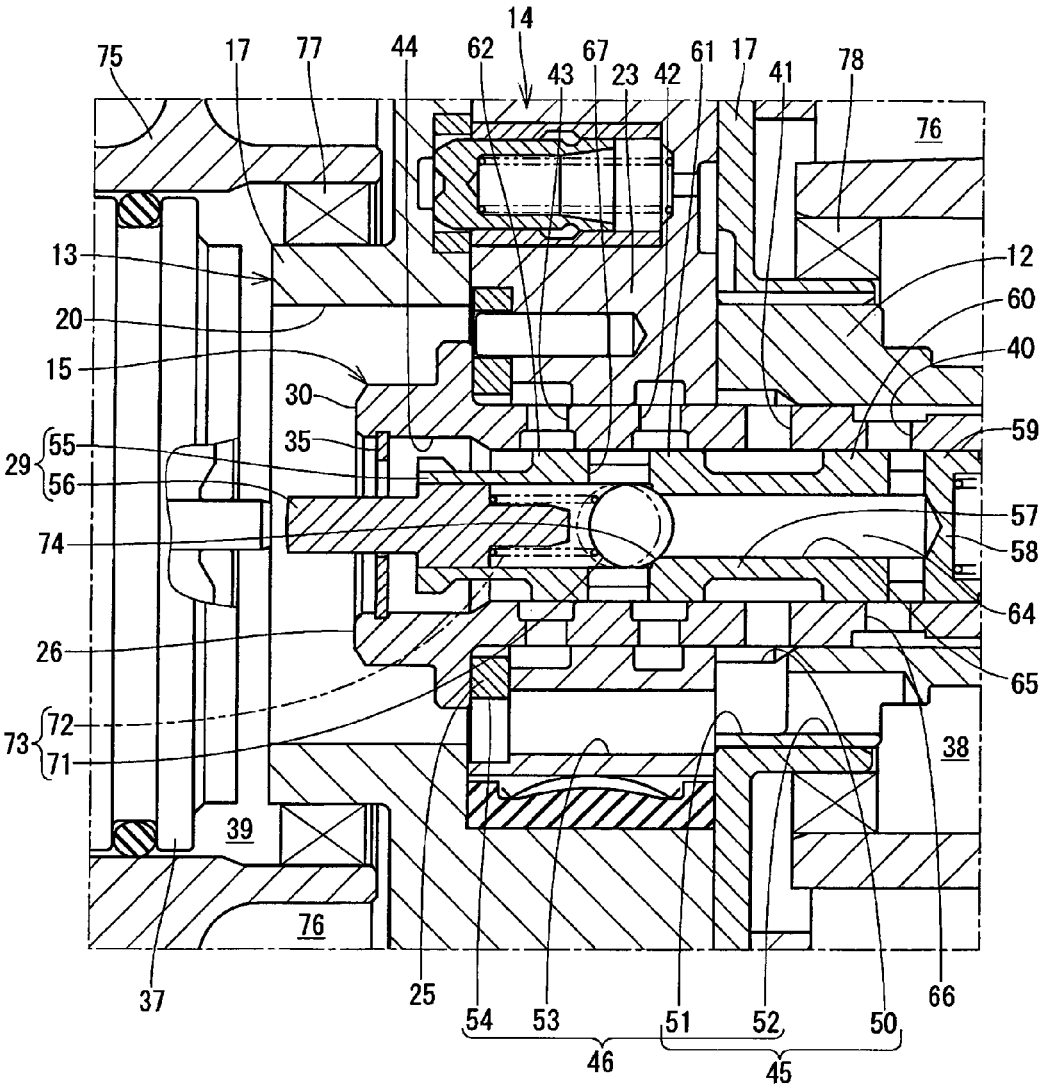
FIG. 5 is a diagram showing the spool that moves by the predetermined distance from a position in FIG. 4.

The bottomed tubular member 55 includes a tubular portion 57 that is coaxial with the sleeve 32, and a bottom portion 58 that is placed at a position close to the cam shaft 12. The bottomed tubular member 55 is movable in the axial direction from a position that the tubular portion 57 is in contact with the stopper plate 35 as shown in FIG. 3 to a position that the bottom portion 58 is in contact with a bottom surface of the spool receiving hole 34 as shown in FIG. 5, through an intermediate position shown in FIG. 4.

The bottomed tubular member 55 includes a first dividing portion 59, a second dividing portion 60, a third dividing portion 61, and a fourth dividing portion 62, in this order from the bottom portion 58. Each of the above dividing portions is a protrusion that is a ring shape and protrudes outwardly in the radial direction from the tubular portion 57 of the bottom portion 58. The thread portion 31 of the sleeve bolt 26 includes a through hole 63 that extends in the axial direction. The first dividing portion 59 divides a space between the through hole 63 and the supply port 40, in a space defined by the bottom surface of the spool receiving hole 34 and the bottomed tubular member 55. The second dividing portion 60 divides a space between the supply port 40 and the drain port 41, in a space defined by the sleeve 32 and the bottomed tubular member 55. The third dividing portion 61 divides a space between the drain port 41 and the first control port 42 or divides a space between the first control port 42 and the second control port 43, in the space defined by the sleeve 32 and the bottomed tubular member 55. The fourth dividing portion 62 divides a space between the first control port 42 and the second control port 43 or divides a space between the second control port 43 and the first drain oil channel 44, in the space defined by the sleeve 32 and the bottomed tubular member 55.

The bottomed tubular member 55 includes an oil connection channel 64 that is arranged at an axial center portion of the bottomed tubular member 55. The oil connection channel 64 controls the supply port 40 to be connected with the first control port 42 or the second control port 43 depending on an axial-direction position of the bottomed tubular member 55. The oil connection channel 64 includes an axial-direction hole 65, an inlet hole 66 that penetrates outwardly in the radial direction between the first dividing portion 59 and the second dividing portion 60 from the axial-direction hole 65, and an outlet hole 67 that penetrates outwardly in the radial direction between the third dividing portion 61 and the fourth dividing portion 62 from the axial-direction hole 65. The inlet hole 66 communicates with the supply port 40 without respect to the axial-direction position of the spool 29. The outlet hole 67 communicates with the first control port 42 at the axial-direction position of the spool 29 as shown in FIG. 3, communicates with the second control port 43 at the axial-direction position of the spool 29 as shown in FIG. 5, and communicates with neither the first control port 42 nor the second control port 43 at the axial-direction position as shown in FIG. 4.

As shown in FIG. 3, the stopper member 56 is pressed into an opening end portion of the tubular portion 57 of the bottomed tubular member 55. The stopper member 56 and the bottomed tubular member 55 are integrally bonded to each other. When the stopper member 56 is pressed toward the linear solenoid 37, the bottomed tubular member 55 moves in the axial direction together with the stopper member 56.

The axial-direction hole 65 of the oil connection channel 64 is provided with a check valve 73 including a valve body 71 and a spring 72. The valve body 71 is a sphere shape, and can be seated on or separated from a valve seat 74 arranged on an inner wall of the axial-direction hole 65. The spring 72 biases the valve body 71 toward the valve seat 74. As solid lines shown in FIGS. 3 to 5, when the valve body 71 is seated on the valve seat 74, the check valve 73 interrupts a flow of the operation oil flowing from the outlet hole 67 to the inlet hole 66 in the oil connection channel 64. As phantom lines shown in FIGS. 3 to 5, when the valve body 71 is separated from the valve seat 74, the check valve 73 allows the flow of the operation oil flowing from the inlet hole 66 to the outlet hole 67.

As shown in FIG. 3, the axial-direction position of the spool 29 of when the spool 29 is in contact with the stopper plate 35 is an initial position that corresponds to the second operation state. When the axial-direction position of the spool 29 is the initial position, the supply port 40 communicates with the second control port 43 through the oil connection channel 64, and the first control port 42 communicates with the drain port 41. In this case, when the operation oil is supplied from the supply port 40 to the oil connection channel 64, the check valve 73 is opened by a fluid pressure of the operation oil, and the supply port 40 communicates with the second control port 43. Therefore, the operation oil of the oil supply channel 91 is supplied to the advance chamber 28 through the supply port 40, the oil connection channel 64, the second control port 43, and the advance oil channel 49. Further, the operation oil in the retard chamber 27 is discharged to the drain space 39 through the retard oil channel 48, the first control port 42, the drain port 41, and the second drain oil channel 45.

When the spool 29 moves from the initial position shown in FIG. 3 by a predetermined distance to a position shown in FIG. 4, communications between the supply port 40, the drain port 41, the first control port 42, and the second control port 43 are blocked. Therefore, the operation oil in the retard chamber 27 and the operation oil in the advance chamber 28 are maintained.

When the spool 29 moves from the position shown in FIG. 4 by a predetermined distance to a position shown in FIG. 5, the supply port 40 communicates with the first control port 42 through the oil connection channel 64, and the second control port 43 communicates with the first drain oil channel 44. In this case, when the operation oil is supplied from the supply port 40 to the oil connection channel 64, the check valve 73 is opened by the fluid pressure of the operation oil, the supply port 40 communicates with the first control port 42. Therefore, the operation oil of the oil supply channel 91 is supplied to the retard chamber 27 through the supply port 40, the oil connection channel 64, the first control port 42, and the retard oil channel 48. Further, the operation oil in the advance chamber 28 flows into the drain space 38 through the second control port 43 and the first drain oil channel 44 and then is discharged to the drain space 39 through the third drain oil channel 46.

As the above description, the valve timing adjusting device 10 according to the first embodiment includes the housing 13, the vane rotor 14, the sleeve 32, and the spool 29. The housing 13 includes the timing pulley 18 connected to the crank shaft 11 through the dry belt 22, and rotates in association with the crank shaft 11. The sleeve 32 includes the supply port 40, the drain port 41, the first control port 42, the second control port 43, and the first drain oil channel 44, in this order from the cam shaft 12. The spool 29 includes the oil connection channel 64 that is arranged at an axial center portion of the spool 29 and controls the supply port 40 to be connected with the first control port 42 or the second control port 43 depending on the axial-direction position. The drain port 41 is connected with the drain space 39 that is out of the cam shaft 12, through the second drain oil channel 45 that is arranged at the cam shaft 12. The drain space 38 is connected with the drain space 39 through the third drain oil channel 46 that spans the vane rotor 14 and the cam shaft 12.

In the valve timing adjusting device 10, the drain space 38 communicates with the drain space 39 through the third drain oil channel 46. Therefore, the operation oil in the advance chamber 28 flows into the drain space 38 through the second control port 43 and the first drain oil channel 44 and then is discharged to the drain space 39 through the third drain oil channel 46. Thus, even though the pulley exposure space 76 is sealed relative to the drain space 38 and the drain space 39, the operation oil discharged from the drain space 38 and the drain space 39 can be returned to the oil storage portion of the internal combustion engine without being leaked. Thus, the oil connection channel 64 is arranged at the axial center portion of the spool 29 of the oil channel switching valve 15, and it can be prevented that the operation oil discharged from the oil channel switching valve 15 to an external space adheres to the timing pulley 18 and the dry belt 22.

According to the first embodiment, the notch 51 and the through hole 52 which are a part of the third drain oil channel 46 are also a part of the second drain oil channel 45.

Therefore, a processing of providing or forming an oil channel can be reduced, and a manufacturing cost can be reduced.

According to the first embodiment, the second drain oil channel 45 is only arranged at the cam shaft 12.

Therefore, it is unnecessary that a ring-shaped groove defining the second drain oil channel 45 is provided in the vane rotor 14. Thus, a size of the valve timing adjusting device 10 in the axial direction can be reduced.

Second Embodiment

Figure 6:
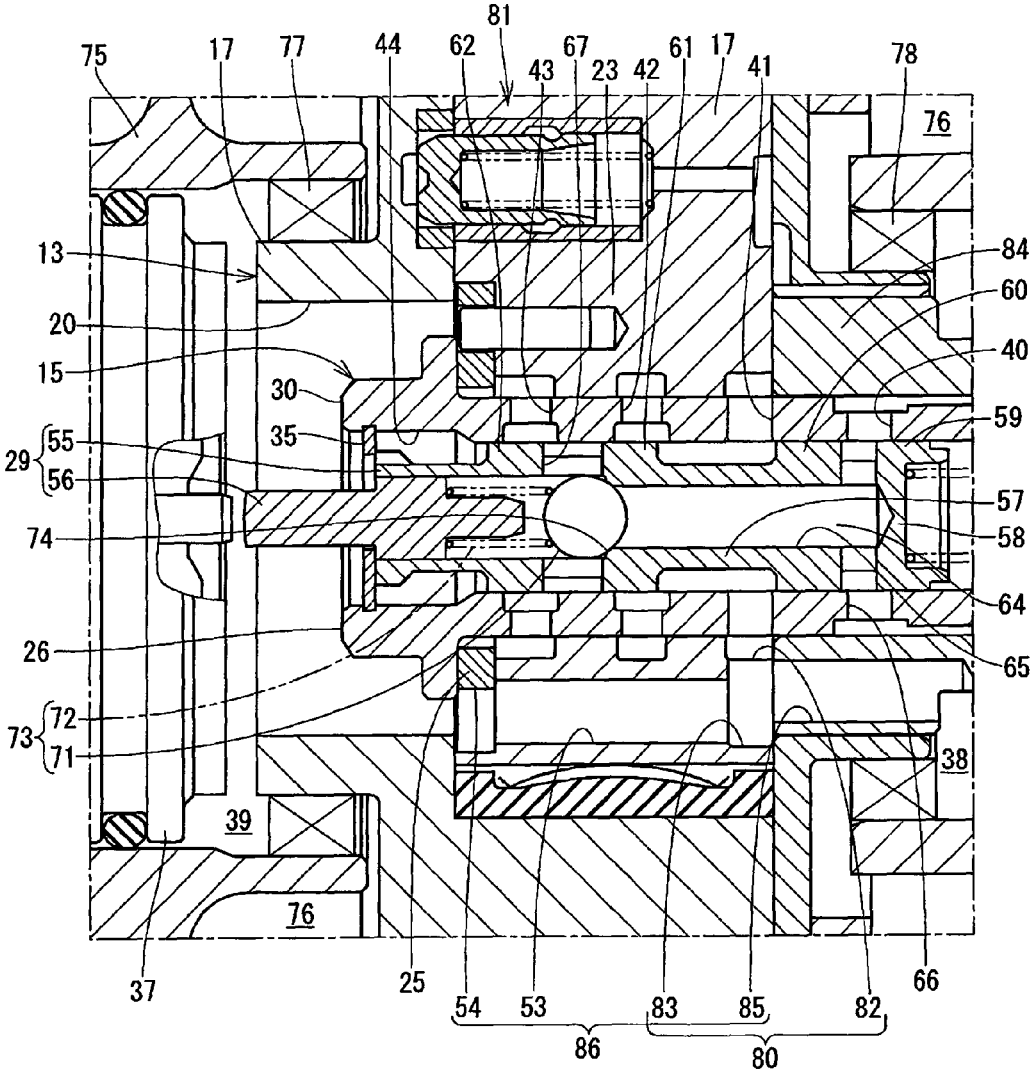
FIG. 6 is cross-sectional view showing the valve timing adjusting device according to a second embodiment of the present disclosure.

According to a second embodiment of the present disclosure, as shown in FIG. 6, a second drain oil channel 80 includes a ring-shaped groove 82, a notch 83, and a through hole 85. The ring-shaped groove 82 and the notch 83 are arranged at a vane rotor 81, and the through hole 85 is arranged at a cam shaft 84. A third drain oil channel 86 includes the notch 54 that is arranged at the vane rotor 81, the through hole 53, the notch 83, and the through hole 85 that is arranged at the cam shaft 84.

According to the second embodiment, the second drain oil channel 80 is arranged to span the vane rotor 81 and the cam shaft 84, and the same effects as the first embodiment can be obtained.

According to the second embodiment, it is unnecessary that a ring-shaped groove and a notch are arranged at the cam shaft 84. Therefore, a manufacturing cost of the cam shaft 84 can be reduced.

Other Embodiment

According to other embodiments of the present disclosure, a part of the third drain oil channel may be not a part of the second drain oil channel. In other words, the third drain oil channel may be completely different from the second drain oil channel.

According to other embodiments of the present disclosure, the second drain oil channel may include a ring-shaped groove that is arranged at the cam shaft or the vane rotor, and a through hole that is arranged at the cam shaft. In other words, the ring-shaped groove and the through hole may directly communicate with each other without providing a notch.

According to other embodiments of the present disclosure, the vane rotor may include plural members. In this case, the second drain oil channel and the third drain oil channel may be a hole or a space which is defined by a member.

According to other embodiments of the present disclosure, the plate washer may be cancelled.

According to other embodiments of the present disclosure, the check valve may be not arranged in the oil connection channel of the spool.

According to other embodiments of the present disclosure, the first oil pressure chamber may be the advance chamber, and the second oil pressure chamber may be the retard chamber.

According to other embodiments of the present disclosure, the housing may include three or more members.

According to other embodiments of the present disclosure, the timing pulley may be placed at any positions of the housing. Further, the timing pulley may be integrally bonded to the case or the cover.

According to other embodiments of the present disclosure, the vane rotor may be fixed to an end portion of the crank shaft, and the housing may rotate in association with the cam shaft.

According to other embodiments of the present disclosure, the outlet hole of the oil connection channel may slightly communicate with the first control port and the second port in the holding state.

According to other embodiments of the present disclosure, the valve timing adjusting device may adjust a valve timing of an exhaust valve of the internal combustion engine.

The present disclosure is not limited to the embodiments mentioned above, and can be applied to various embodiments within the spirit and scope of the present disclosure.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A valve timing adjusting device arranged in a power transmission passage that transmits a power from a driving shaft of an internal combustion engine to a driven shaft of the internal combustion engine, the valve timing adjusting device adjusting a valve timing of a valve driven to open and to close by the driven shaft, the valve timing adjusting device comprising:

a housing including a timing pulley connected to a first shaft through a dry belt, the housing rotating in association with the first shaft, wherein one of the driving shaft and the driven shaft is expressed as the first shaft, and the other one of the driving shaft and the driven shaft is expressed as a second shaft;

a vane rotor fixed to an end portion of the second shaft, the vane rotor including a vane dividing an inner space of the housing into a first oil pressure chamber and a second oil pressure chamber which are arranged at one side and the other side relative to the vane in a peripheral direction, respectively, the vane rotor rotating relative to the housing depending on oil pressures of operation oil supplied to the first oil pressure chamber and the second oil pressure chamber;

a sleeve arranged at a center portion of the vane rotor, the sleeve including a supply port that communicates with an oil supply channel of the second shaft, a drain port that communicates with a first drain space placed at a position out of the second shaft, a first control port that communicates with the first oil pressure chamber, a second control port that communicates with the second oil pressure chamber, and a first drain oil channel that communicates with a second drain space opposite to the second shaft relative to the vane rotor, in this order from the second shaft; and a spool moving in an axial direction in the sleeve, the spool including an oil connection channel that is arranged at an axial center portion of the spool and controls the supply port to be connected with the first control port or the second control port depending on an axial-direction position of the spool, the spool controlling the supply port to be connected with the first control port and controlling the second control port to be connected with the first drain oil channel in a case where the operation oil is supplied to the first oil pressure chamber, the spool controlling the supply port to be connected with the second control port and controlling the first control port to be connected with the drain port in a case where the operation oil is supplied to the second oil pressure chamber, wherein the drain port is connected with the first drain space through a second drain oil channel that is arranged in the second shaft or is provided to span the vane rotor and the second shaft, and the second drain space is connected with the first drain space through a third drain oil channel that is provided to span the vane rotor and the second shaft.

2. The valve timing adjusting device according to claim 1, wherein the third drain oil channel includes a part that is a part of the second drain oil channel.

3. The valve timing adjusting device according to claim 2, wherein the second drain oil channel is only arranged at the second shaft.

4. The valve timing adjusting device according to claim 2, wherein the second drain oil channel includes a front part arranged at the vane rotor and a rear part arranged at the second shaft.

* * * * *